United States Patent [19]

Sampath et al.

[11] Patent Number: 4,874,958

[45] Date of Patent: Oct. 17, 1989

[54] SHEET EDGE DETECTOR

[75] Inventors: Barbara A. Sampath, Fairport; Richard C. Schenk, Webster, both of N.Y.

[73] Assignee: Xerox Corporation, Stamford, Conn.

[21] Appl. No.: 253,151

[22] Filed: Oct. 4, 1988

[51] Int. Cl.[4] ..... G03G 15/00

[52] U.S. Cl. ..... 355/309; 355/204; 355/316; 355/317; 355/318; 355/319; 271/152; 271/265

[58] Field of Search ..... 355/309, 308, 311, 316, 355/317, 318, 203, 204, 319, 320; 271/3.1, 9, 110, 152, 153, 265

[56] References Cited

U.S. PATENT DOCUMENTS

| | | | |
|---|---|---|---|
| 4,302,105 | 11/1981 | Sick | 366/237 |
| 4,323,311 | 4/1982 | West et al. | 356/431 |
| 4,485,949 | 12/1984 | Gebhart et al. | 226/2 |
| 4,580,890 | 4/1986 | Sugizaki et al. | 355/309 |
| 4,609,815 | 9/1986 | Hishinuma et al. | 250/222.1 |
| 4,641,272 | 2/1987 | Sasaki et al. | 358/309 X |
| 4,681,425 | 7/1987 | Tanimoto | 355/309 |
| 4,733,281 | 5/1988 | Yoshinaga et al. | 355/309 X |
| 4,763,162 | 8/1988 | Yagasaki | 358/309 X |

*Primary Examiner*—A. C. Prescott

*Attorney, Agent, or Firm*—H. Fleischer; J. E. Beck; R. Zibelli

[57] ABSTRACT

An apparatus which determines the location of an edge of an advancing sheet and discriminates between a hole therein. After the leading edge of the sheet is detected and the sheet has moved a first predetermined distance, the absence or presence of the sheet is sensed for a second predetermined distance. If the sheet is not detected as it moves the second predetermined distance, the control logic indicates that the trailing edge has been detected. In the event the sheet is sensed, the control logic indicates that a hole has been detected and the process is repeated to locate the trailing edge.

17 Claims, 3 Drawing Sheets

SHEET EDGE DETECTOR

This invention relates generally to an electrophotographic printing machine, and more particularly concern an apparatus for discriminating between an edge of a copy sheet and a hole therein.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attached from the carrier granules to the latent image forming a toner powder image on the photoconductive member. The toner powder image is then transferred from the photoconductive member to a copy sheet. The toner particles are heated to permanently affix the powder image to the copy sheet.

In a high speed commercial printing systems of the foregoing type, the copy sheets with the information permanently affixed thereto, are transported to a finishing station. Frequently each copy sheet has information reproduced on both sides of the sheet, i.e. it is a duplex sheet. When a duplex copy sheet is advanced to the finishing station, it is inverted in order to place the sheets in the proper sequence and orientation for binding or stapling. An inverter receives the leading edge of the sheet. The inversion process is completed with the former trailing edge becoming the leading edge and the former leading edge becoming the trailing edge. In order to determine when to advance the sheet from the inverter, it is necessary to determine when the trailing edge of the sheet has entered the inverter. Generally, an edge sensor, such as a photosensor, detects both the leading and trailing edges and actuates the inverter to advance the sheet therefrom after the trailing edge has been sensed. However, in the event the copy sheet has holes punched in the trailing marginal region, e.g. three hole paper, the photosensor will erroneously indicate that the holes in the trailing marginal region of the sheet are the trailing edge of the sheet and the inverter will be actuated prematurely to eject the sheet therefrom. Accordingly, in order to prevent the premature ejection of the copy sheet from the inverter, it is necessary to distinguish between the trailing edge and holes therein. Various approaches have been devised for detecting holes in sheets. The following disclosures appear to be relevant:

US-A-4,302,105, Patentee: Sick, Issued: November 24, 1981.

US-A-4,323,311, Patentee: West et al., Issued: April 6, 1982.

US-A-4,485,949, Patentee: Gebhart et al., Issued: December 4, 1984.

US-A-4,609,815, Patentee: Hishinuma et al., Issued: September 2, 1986.

The relevant portions of the foregoing patents may be summarized as follows:

US-A-4,302,105 discloses a laser which directs a beam onto a row of stepped mirrors. A row of Fresnel lenses are located directly behind a web. The web is being monitored to determine if there are holes therein. The Fresnel lenses concentrate the light which is incident on them through the holes onto a photoelectric converter. The photoelectric converters are associated with a processing circuit to detect the light transmitted through any holes in the web.

US-A-4,323,311 describes an apparatus for detecting holes in sheet material, such as tin plate. The apparatus uses a laser for generating a beam that is reflected from a multifaceted mirror drum onto a pair of mirrors and then onto the moving sheet. Light collectors focus the laser beam transmitted through the sheet onto a photomultiplier. The signal from the photomultiplier is passed to a signal processing apparatus.

US-A-4-485,949 discloses an infrared light source which transmits dual parallel beams onto a web having sprocket holes therein. Dual photodetectors receive the beam transmitted through the sprocket holes. The photodetectors are connected to a common "OR" output which validates presence of a sprocket hole.

US-A-4,609,815 a light emitting diode which generates light rays onto a colored sheet. If the light emitting from the light emitting diode contacts the sheet, a weak intensity light is reflected toward a phototransistor. If a hole in the sheet is opposite the light emitting diode, the light emitted from the light emitting diode is strongly reflected by a reflector so that a strongly reflected light is received by the phototransistor. In this way, it is possible to detect the hole in the sheet.

In accordance with one aspect of the present invention, there is provided an apparatus for determining the location of an edge of a sheet. The apparatus includes means for advancing the sheet. Means are provided for distinguishing between the edge of the sheet and a hole in the marginal region thereof.

Pursuant to another aspect of the features of the present invention, there is provided an electrophotographic printing machine of the type in which it is necessary to discriminate between an edge of the copy sheet and a hole therein. The improvement in the printing machine includes means for advancing the sheet. Means are provided for distinguishing between the edge of the sheet and a hole in the marginal region thereof.

Still another aspect of the features of the present invention includes a method of determining the edge of a sheet. The method includes the steps of advancing the sheet, and distinguishing between the edge of the sheet and a hole in the marginal region thereof.

Other aspects of the present invention will become apparent as the following description proceeds and upon reference to the drawings, in which.

While the present invention will hereinafter be described in connection with a preferred embodiment and method of use, it will be understood that it is not intended to limit the invention to that embodiment and method of use. On the contrary, it is intended to cover all alternatives, modifications, and equivalents, as may be included within the spirit and scope of the invention as defined by the appended claims.

Figure 1:
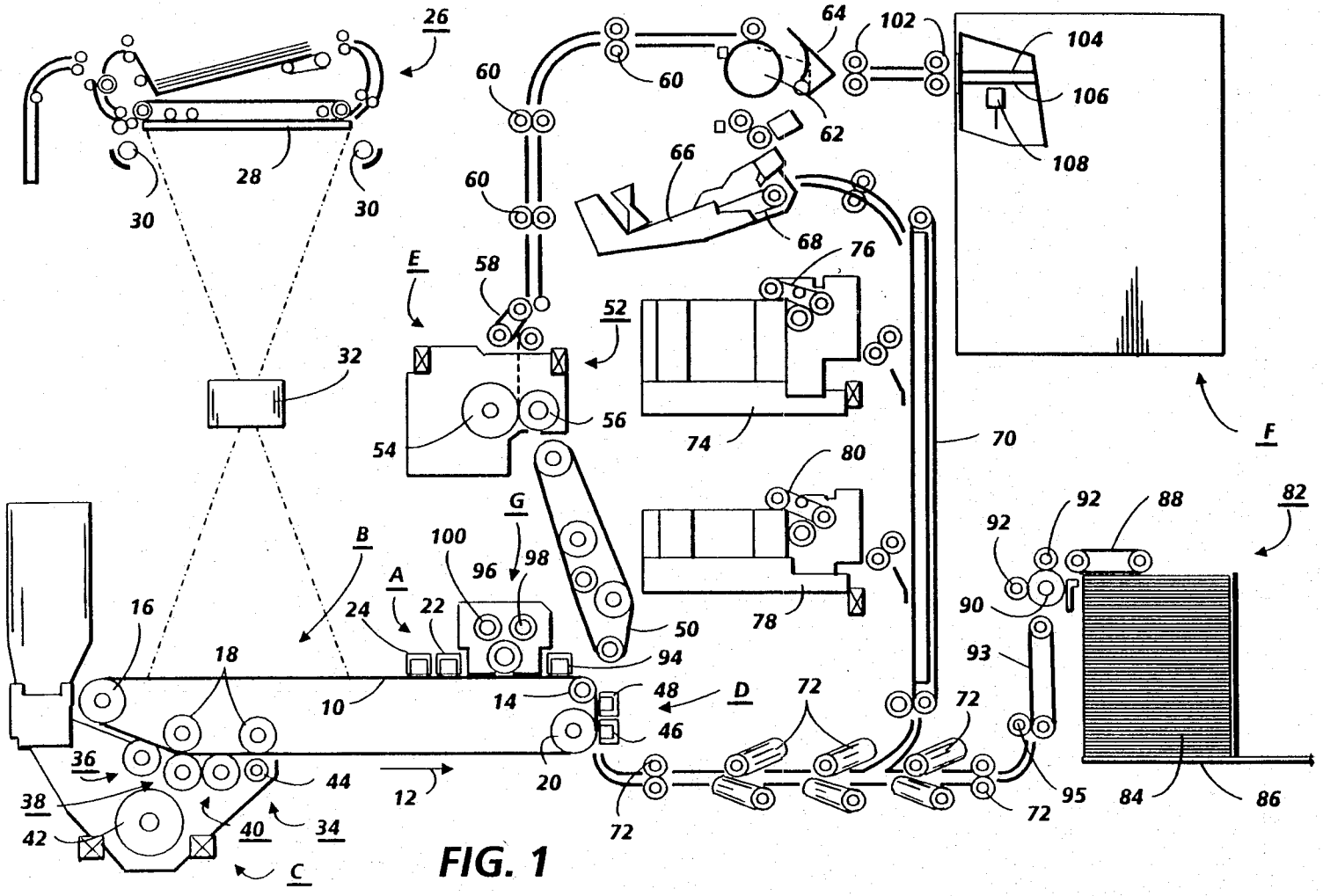
FIG. 1 is a schematic elevational view depicting an illustrative electrophotographic printing machine incorporating the apparatus of the present invention therein.

For general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the apparatus and method of the present invention may be employed in a wide variety of devices and is not specifically limited in its application to the particular embodiment or method of use described herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up into the document tray on top of the document handling unit. A document feeder located below the tray forwards the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or if this is the first pass of a duplex copy, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the document are transmitted through lens 32. Lens 32 focuses light images of the original document onto the charged portion of the photoconductive surface of belt 10 to selectively dissipate the charge thereon. This records an electrostatic latent image on photoconductive belt 10 which corresponds to the informational areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36, 38 and 40. A paddle wheel 42 picks up developer material and delivers it to the developer rolls. When developer material reaches rolls 36 and 38, it is magnetically split between the rolls with half of the developer material being delivered to each roll. Photoconductive belt 10 is partially wrapped about rolls 36 and 38 to form extended development zones. Developer roll 40 is a cleanup roll. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10. Conveyor 50 advances the copy sheet to fusing station E.

Fusing station E includes a fuser assembly, indicated generally by the reference numeral 52 which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller is crammed against the fuser roller to provide the necessary pressure to fix the toner powder image to the copy sheet. The fuser roller is internally heated by a quartz lamp. A release agent, stored in a reservoir, is pumped to a metering roll. A trim blade trims off the excess release agent. The release agent transfers to a donor roll and then to the fuser roll.

After fusing, the copy sheets are fed through a decurler 58. Decurler 58 bends the copy sheet in one direction to put a known curl in the copy sheet and then bends it in the opposite direction to remove that curl.

Forwarding rollers 60 then advance the sheet to duplex turn roll 62. Duplex solenoid gate 64 guides the sheet to the finishing station F or to duplex tray 66. Rolls 102 advance the sheet between opposed parallel plates 104 and 106. A sensor, indicated generally by the reference numeral 108 determines the location of the leading and trailing edges of the sheet. Further details of the portion of the finishing station F having sensor 108 and the method of determining the location of the trailing edge of the sheet will be described hereinafter with reference to FIGS. 2 through 4, inclusive.

With continued reference to FIG. 1, duplex solenoid gate 64 diverts the sheet into duplex tray 66. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70 and rollers 72 for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74. The secondary tray 74 includes an elevator driven by a bidirectional AC motor. The controller has the ability to cause the motor to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away drive roll 90 and idler rolls 92. The drive roll and idler rolls guide the sheet onto transport 93. Transport 93 and idler roll 95 advance the sheet to rolls 72 which, in turn, move the sheet to transfer station station D.

Invariably, after the copy sheet is separated from the photoconductive surface of belt 10, some residual particles remain adhering thereto. After transfer, photoconductive belt 10 passes beneath corona generating device 94 which charges the residual toner particles to the proper polarity. Thereafter, a precharge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
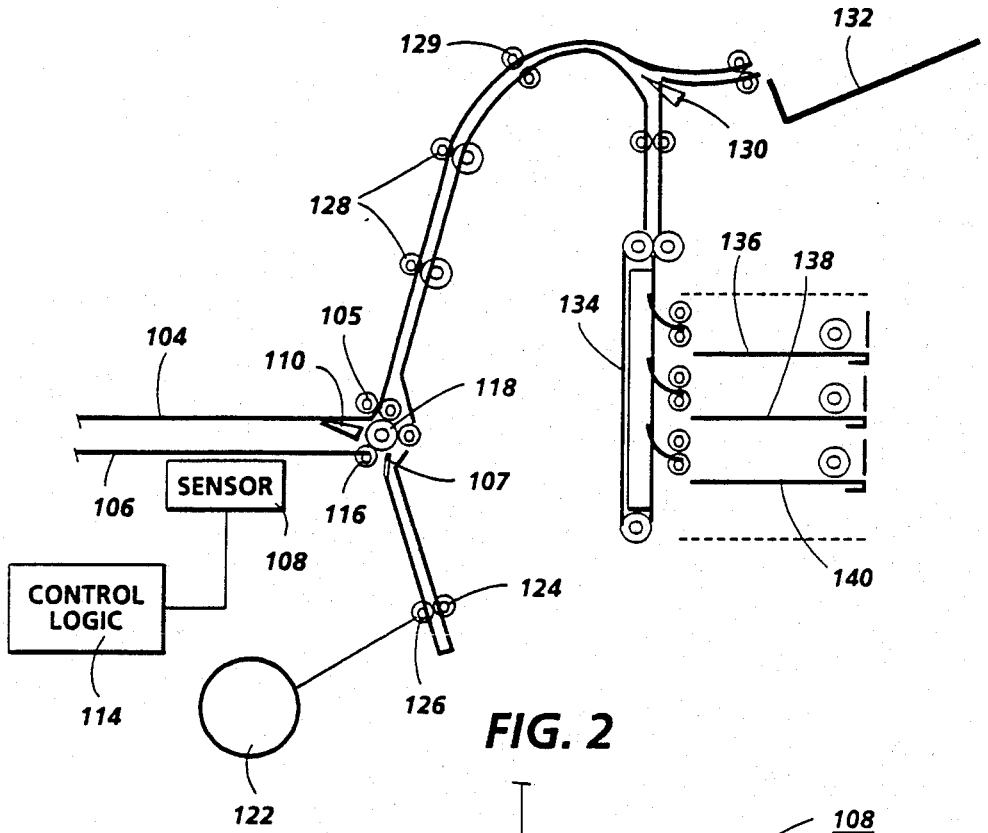
FIG. 2 is a fragmentary, schematic elevational view showing the portion of the FIG. 1 finishing station having apparatus of the present invention therein.

Referring now to FIG. 2, the general operation of the apparatus determining the edges of the advancing copy sheet entering Finishing station F will now be described. Finishing station F receives fused copies from rolls 102 (FIG. 1) and delivers them to solenoid actuated gate 110. Gate 110 diverts the copy sheet to either bypass drive rolls 105 or passive gate 107 of inverter 112. Sensor 108 is coupled to control logic 114 and, in conjunction therewith, determines the leading and trailing edges of the copy sheet being advanced between plates 104 and 106 by forwarding rolls 102. As shown in FIG. 2, gate 110 is positioned to deflect the advancing copy sheet into inverter 112. A tri-roll nip defined by rolls 116, 118, and 120, is used to drive sheets into and out of the inverter. A reversible AC motor 122 is actuated by control logic 114 after the leading edge of the copy sheet is detected by sensor 108. Motor 122 drives rolls 124 and 126 assist in moving the copy sheet into inverter 112. Next, sensor 108 and control logic 114 discriminate between the trailing edge of the advancing copy sheet and holes punched in the trailing marginal region thereof. When control logic 114 determines that the trailing edge of the copy sheet has entered inverter 112, motor 122 drives rollers 126 in the reverse direction. Two cross roll registration nips defined by registration rolls 128 are used to register the sheets. The cross roll registration rolls are driven by the sheet path drive motor. Sheet path drive rolls 129 advance the copy sheets to gate 130. Gate 130 diverts the sheets to either the top tray 132 or to vertical transport 134. Vertical transport 134 is a vacuum transport which transports sheets to any one of three bins 136, 138 or 140. Bins 136, 138, and 140 are used to compile and register sheets into sets. The bins are driven up or down by a bidirectional AC bin drive motor adapted to position the proper bin at the unloading position. Thereafter, a set transport is used to transport sets from the bins to a sheet stapling apparatus, binder and sheet stacker. The stapled, bound, or unfinished sets are then delivered to a stacker where they are stacked for delivery to the operator.

Figure 3:
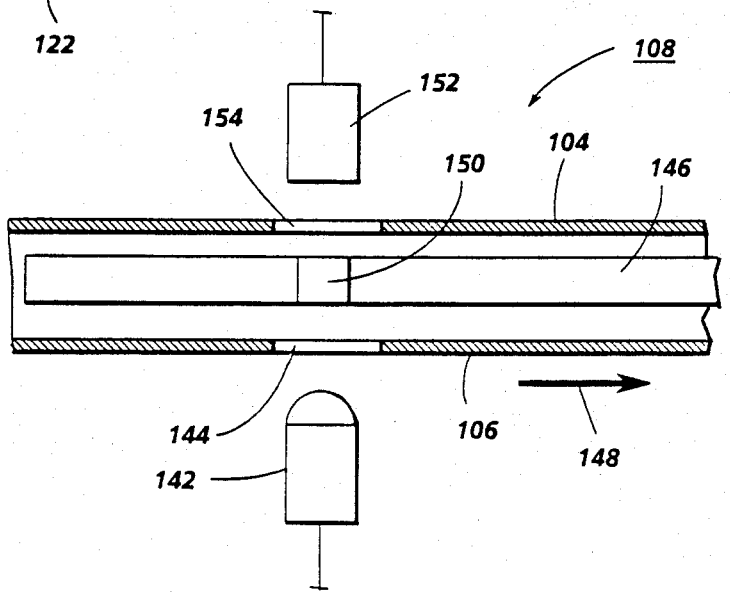
FIG. 3 is a fragmentary, schematic elevational view further illustrating the apparatus of the present invention.

Turning now to FIG. 3, there is shown sensor 108 in greater detail. As illustrated thereat, sensor 108 includes a light emitting diode 142 emitting light through opening 144 in plate 106. The trailing marginal region of copy sheet 146 is shown moving in the direction of arrow 148 between plates 104 and 106. Copy sheet 146 is depicted with a hole 150 punched in the trailing marginal region thereof. Prior to the leading edge of copy sheet 146 being interposed between light emitting diode 142 and photodiode 152, the light rays emitted from light emitting diode 142 pass through opening 144 in plate 106 and opening 154 in plate 104 so as to be received by photodiode 152. As copy sheet 146 advances between light emitting diode 142 and photodiode 152, the light rays emitted from light emitting diode 142 are blocked and not received by photodiode 152. A timer in the circuitry of 114 measures the elapsed time and, after a predetermined time of several milliseconds has elapsed corresponding to sheet 146 moving a first predetermined distance of about 3¼ inches for an 8½ by 11 inch sheet, control logic 114 continuously monitors sensor 108. Prior to this, the signal from sensor 108 is blocked. After the copy sheet has moved the first predetermined distance, the signal from sensor 108 is continuously monitored. As hole 150 of sheet 146 passes between holes 144 and 154 in plates 106 and 104, respectively, the light rays emitted from light emitting diode 142 passes through hole 150 and are detected by photodiode 152. Photodiode 152 transmits an electrical signal to control logic 114 indicating the absence of sheet 146, i.e. the presence of hole 150. However, at this time, the control logic cannot ascertain whether a hole or the trailing edge of the copy sheet has been detected. Therefore, control logic 114 continues to monitor sensor 108 for another time period corresponding to sheet 146 moving a second predetermined distance of about 1 inch. If a hole has been sensed previously, the trailing marginal region of the copy sheet will be interposed between light emitting diode 142 and photodiode 152. The light rays emitted from light emitting diode 142 will no longer be transmitted to photodiode 152 and control logic 114 will receive a signal corresponding thereto. At this time, control logic 114 has sufficient information to determine that a hole rather than the trailing edge of the copy sheet has been sensed and the foregoing process will be repeated until the light rays emitted from light emitting diode 142 are detected by photodiode 152 ad the copy sheet moves the second predetermined distance. At that time, the control logic reverses direction of motor 122 and moves the copy sheet out of inverter 112 for further processing in the finishing station.

Figure 4:
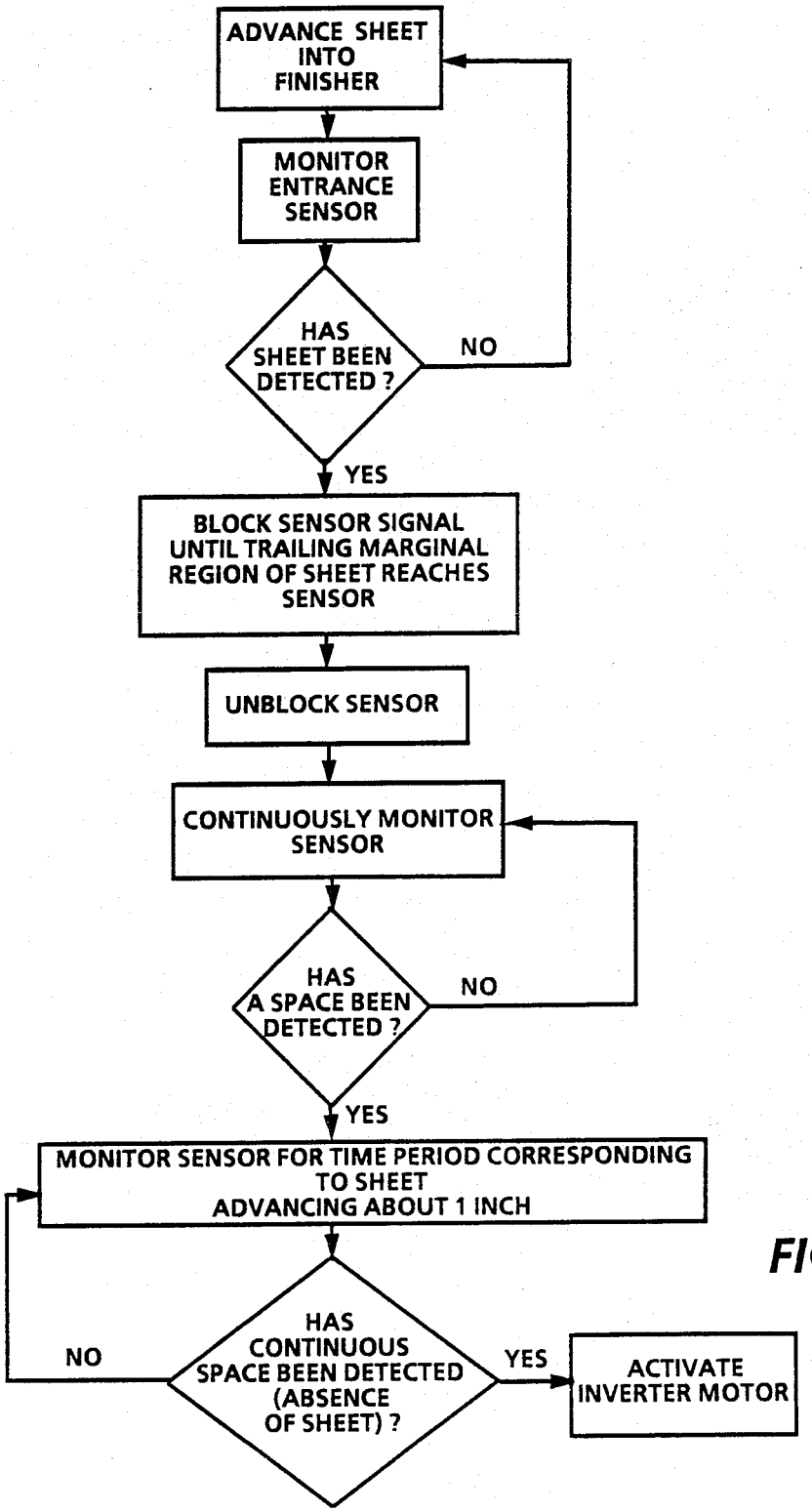
FIG. 4 is a flow diagram describing the process for determining the location of an edge of a sheet.

Turning now to the FIG. 4, there is shown a flow diagram of the method of determining the edges of the copy sheet. Initially, the copy sheet is advanced into Finishing station F and the entrance sensor 108 monitored. The signal from the entrance sensor is transmitted to the control logic. The sheet continues to advance into the Finishing station and, when the leading edge is detected by sensor 108, control logic 114 blocks the sensor signal until the trailing marginal region of the copy sheet reaches sensor 108, i.e. the copy sheet has advanced past sensor 108 a first predetermined distance. After the copy sheet has advanced the first predetermined distance, the signal from sensor 108 is unblocked and sensor 108 is continuously monitored. This is continued until a space, i.e. either a hole or the trailing edge of the copy sheet is detected. After the space is detected, the sensor is monitored continuously until the copy sheet moves a second predetermined distance of about 1 inch. If, as the copy sheet is moving this second predetermined distance, a space, i.e. the continuous absence of the copy sheet, is detected, then the trailing edge of the copy sheet has been sensed. Alternatively, if the copy sheet is detected rather than a space, a hole has been sensed and the process is repeated, i.e. the sensor is monitored continuously for another 1 inch of movement. When the trailing edge of the copy sheet is detected, the control logic actuates the inverter motor, in the reverse direction, to eject the copy sheet from the inverter for subsequent processing by the Finishing station.

In recapitulation, the sensor and control logic operate in conjunction with one another to detect the leading edge of the copy sheet and to subsequently discriminate between the trailing edge of the copy sheet and a punched hole in the trailing marginal region thereof. Upon determining that the trailing edge of the copy sheet has been sensed, the inverter motor is reversed so as to eject the copy sheet from the inverter.

It is, therefore, evident that there has been provided, in accordance with the present invention, an apparatus and method for determining the leading and trailing edges of a copy sheet and distinguishing between punched holes and an edge of the sheet. This apparatus fully satisfies the aims and advantages hereinbefore set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for determining the location of an edge of a sheet, including:

means for advancing the sheet; and means for distinguishing between the edge of the sheet and a hole in the marginal region thereof.

2. An apparatus according to claim 1, wherein said distinguishing means includes:

control logic; and means, coupled to said control logic, for detecting the sheet, said sheet detecting means sensing the presence of the leading edge of the sheet and, after the sheet advances about a first predetermined distance, the absence of the sheet and transmitting signals corresponding thereto to said control logic, said control logic indicating that the absence of the sheet, after the sheet has advanced about the first predetermined distance, corresponds to the location of the trailing edge of the sheet when said detecting means continues to sense the absence of the sheet as the sheet advances about a second predetermined distance.

3. An apparatus according to claim 2, wherein said control logic indicates the presence of a hole in the sheet when said detecting means detects the presence of the sheet as the sheet advances the second predetermined distance.

4. An apparatus according to claim 3, wherein said detecting means includes a photosensor for detecting the presence and absence of the sheet.

5. An apparatus according to claim 4, wherein said photosensor includes:

a light source; and a light detector positioned to receive the light rays from said light source and generating a signal when the light rays from said light source are transmitted thereto, said advancing means being adapted to move the sheet between said light source and said light detector so that, when the sheet is interposed between said light source and said light detector, the light rays from said light source are blocked by the sheet.

6. An apparatus according to claim 5, wherein:

said light source includes a light emitting diode; and said light detector includes a photodiode.

7. An electrophotographic printing machine of the type in which it is necessary to discriminate between an edge of the copy sheet and a hole therein, wherein the improvement includes:

means for advancing the sheet; and means for distinguishing between the edge of the sheet and a hole in the marginal region thereof.

8. A printing machine according to claim 7, wherein said distinguishing means includes:

control logic; and means, coupled to said control logic, for detecting the sheet, said sheet detecting means sensing the presence of the leading edge of the sheet and, after the sheet advances about a first predetermined distance, the absence of the sheet and transmitting signals corresponding thereto to said control logic, said control logic indicating that the absence of the sheet, after the sheet has advanced about the first predetermined distance, corresponds to the location of the trailing edge of the sheet when said detecting means continues to sense the absence of the sheet as the sheet advances about a second predetermined distance.

9. A printing machine according to claim 8, wherein said control logic indicates the presence of a hole in the sheet when said detecting means detects the presence of the sheet as the sheet advances the second predetermined distance.

10. A printing machine according to claim 9, wherein said detecting means includes a photosensor for detecting the presence and absence of the sheet.

11. A printing machine according to claim 10, wherein said photosensor includes:

a light source; and a light detector positioned to receive the light rays from said light source and generating a signal when the light rays from said light source are transmitted thereto, said advancing means being adapted to move the sheet between said light source and said light detector so that, when the sheet is interposed between said light source and said light detector, the light rays from said light source are blocked by the sheet.

12. A printing machine according to claim 11, wherein:

said light source includes a light emitting diode; and said light detector includes a photodiode.

13. A printing machine according to claim 8, further including means, responsive to control logic indicating that the trailing edge of the sheet has been detected, for inverting the sheet.

14. A method of determining the edge of a sheet, including the steps of:

advancing the sheet; and distinguishing between the edge of the sheet and a hole in the marginal region thereof.

15. A method according to claim 14, wherein said step of distinguishing means includes the steps of:

detecting the presence of the leading edge of the sheet and, after the sheet advances about a first predetermined distance, the absence of the sheet; and indicating that the absence of the sheet, after the sheet has advanced about the first predetermined distance, corresponds to the location of the trailing edge of the sheet when the absence of the sheet is continued to be sensed as the sheet advances about a second predetermined distance.

16. A method according to claim 15, wherein said step of indicating indicates the presence of a hole in the sheet when the presence of the sheet is sensed as the sheet advances the second predetermined distance.

17. A method according to claim 16, wherein said step of detecting includes the steps of:

emitting light rays; and generating a signal in response to receiving light rays in the absence of the sheet with the light rays being blocked by the presence of the sheet.

* * * * *